US010474076B2

(12) United States Patent
Sonoyama et al.

(10) Patent No.: US 10,474,076 B2
(45) Date of Patent: Nov. 12, 2019

(54) FIXING DEVICE AND IMAGE FORMING APPARATUS

(71) Applicant: KONICA MINOLTA, INC., Chiyoda-ku, Tokyo (JP)

(72) Inventors: Masashi Sonoyama, Toyokawa (JP); Hidetoshi Katayanagi, Tokyo (JP); Yoshikazu Kuribayashi, Okazaki (JP); Tomoya Sato, Toyokawa (JP); Hiroyuki Maeda, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 16/164,009

(22) Filed: Oct. 18, 2018

(65) Prior Publication Data

US 2019/0137916 A1 May 9, 2019

(30) Foreign Application Priority Data

Nov. 7, 2017 (JP) ..... 2017-215110

(51) Int. Cl.
*G03G 15/20* (2006.01)

(52) U.S. Cl.
CPC ..... *G03G 15/2064* (2013.01); *G03G 15/2053* (2013.01); *G03G 2215/2038* (2013.01)

(58) Field of Classification Search
CPC ..... G03G 15/20; G03G 15/2053; G03G 15/2057; G03G 15/206; G03G 15/2064; G03G 2215/2038
See application file for complete search history.

(56) References Cited

U.S. PATENT DOCUMENTS

2012/0155936 A1* 6/2012 Yamaguchi ..... G03G 15/2046 399/329
2013/0195524 A1* 8/2013 Ishii ..... G03G 15/206 399/329

FOREIGN PATENT DOCUMENTS

| | | |
|---|---|---|
| JP | 2010181821 A | 8/2010 |
| JP | 2011107362 A | 6/2011 |
| JP | 2013152435 A | 8/2013 |
| JP | 2016110020 A | 6/2016 |

* cited by examiner

*Primary Examiner* — Hoang X Ngo
(74) *Attorney, Agent, or Firm* — Buchanan Ingersoll & Rooney PC

(57) ABSTRACT

A fixing device fixes a toner image onto a piece of paper by conveying the piece of paper formed with the toner image while nipping the piece of paper at a fixing nip, and includes: an endless belt that is rotated; a pressing member that presses the belt; a support member that supports the pressing member; a sheet wound around the pressing member along the conveyance direction; and a pressurizing member that forms the fixing nip with the belt, wherein a part of an upstream region of the sheet existing more on an upstream side in a winding direction than a contact region contacting the belt and the pressing member and a part of a downstream region of the sheet existing more on a downstream side in the winding direction than the contact region are interposed between the pressing member and the support member, and are fixed by pressing force.

15 Claims, 8 Drawing Sheets

FIXING DEVICE AND IMAGE FORMING APPARATUS

The entire disclosure of Japanese patent Application No. 2017-215110, filed on Nov. 7, 2017, is incorporated herein by reference in its entirety.

BACKGROUND

Technological Field

The present invention relates to a fixing device and an image forming apparatus. More specifically, the present invention relates to a fixing device and an image forming apparatus having excellent assemblability.

Description of the Related Art

Examples of an electrophotographic image forming apparatus include: a multi-function peripheral (MFP) having a scanner function, a facsimile function, a copy function a function as a printer, a data communication function, and a server function; a facsimile machine; a copy machine; a printer, and the like.

Generally, an image forming apparatus forms an image on a recording medium by: forming a toner image by developing, with a developing device, an electrostatic latent image formed on an image carrier, transferring the toner image to the recording medium, and then fixing the toner image on the recording medium by a fixing device. Additionally, among image forming apparatuses, there is an image forming apparatus in which a toner image is formed by developing, with a developing device, an electrostatic latent image formed on a photoreceptor, the toner image is transferred to an intermediate transfer belt by using a primary transfer roller, and the toner image on the intermediate transfer belt is secondarily transferred to a recording medium by using a secondary transfer roller.

Among fixing devices, there is a fixing device including: a rotational endless belt; a pressing member that presses the belt from an inner side of the belt; and a pressurizing member that forms a fixing nip with the belt by pressing the belt from an outer side of the belt. Regarding this type of fixing device, JP 2010-181821 A and JP 2011-107362 A disclose a technique in which a sliding sheet member having a small friction coefficient is installed on a sliding surface of the pressing member in order to improve slidability between the pressing member and the belt.

JP 2010-181821 A discloses the technique in which both ends of a low-friction sheet member wound in a sliding direction in a manner enveloping a fixing nip side of a pad are nipped and held between a leaf spring member and the pad by elastic force of the leaf spring member.

JP 2011-107362 A discloses the technique in which a lubricant sheet is wound around a nip forming member and a fixing member and a folded portion of the lubricant sheet is held between a support plate and the fixing member to fix the folded portion and the support plate to the fixing member with screws.

Note that the technique of installing the low-friction sheet member on the sliding surface of the pressing member is also disclosed in JP 2013-152435 A and 2016-110020 A.

In techniques of JP 2010-181821 A and 2011-107362 A, a sliding sheet is wound around a pad without clearance and fixed by fixtures such as screws and a leaf spring in a state where an end portion of the sliding sheet is nipped between metal sheets in order to prevent a problem that the sliding sheet is wrinkled at a fixing nip and an image defect is caused. As a result, there is a problem that assemblability is not smooth and the number of components is increased.

SUMMARY

The present invention has been made to solve the above-described problem, and an object of the present invention is to provide a fixing device and an image forming apparatus having excellent assemblability.

Another object of the present invention is to provide a fixing device and an image forming apparatus in which increase in the number of components can be suppressed.

To achieve at least one of the abovementioned objects, according to an aspect of the present invention, there is provided a fixing device that fixes a toner image onto a piece of paper by conveying, in a predetermined conveyance direction, the piece of paper formed with the toner image while nipping the piece of paper at a fixing nip, and the fixing device reflecting one aspect of the present invention comprises: an endless belt that is rotated; a pressing member that is arranged on an inner side of the belt and presses the belt from the inner side; a support member that supports the pressing member, a sheet wound around the pressing member along the conveyance direction in a loosely fitted state; and a pressurizing member that is arranged on an outer side of the belt and forms the fixing nip with the belt by pressing, from the outer side of the belt, a part of the belt pressed by the pressing member, wherein in a case of defining, as a winding direction, a direction obtained by extending the conveyance direction along the sheet, a part of an upstream region of the sheet existing more on an upstream side in the winding direction than a contact region contacting the belt and the pressing member and a part of a downstream region of the sheet existing more on a downstream side in the winding direction than the contact region are interposed between the pressing member and the support member, and are fixed by pressing force with which the pressurizing member presses the belt.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments.

In the following embodiment, a case where an image forming apparatus on which a fixing device is mounted is an MFP will be described. The image forming apparatus on which the fixing device is mounted may be not only the MFP but also a facsimile machine, a copy machine, a printer, and the like, and may be for either monochrome or color.

Figure 1:
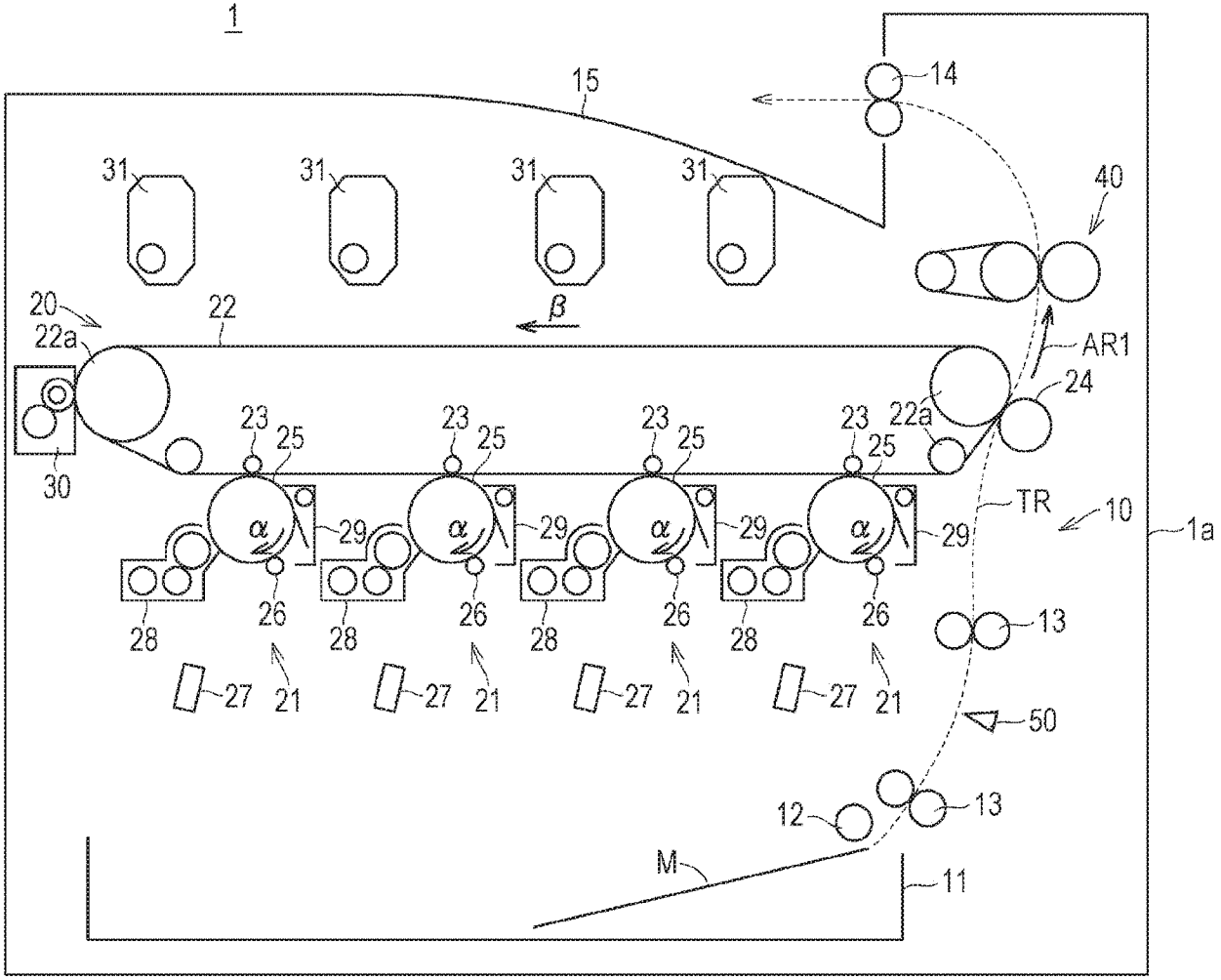
FIG. 1 is a cross-sectional view schematically illustrating a structure of an image forming apparatus according to an embodiment of the present invention.

FIG. 1 is a cross-sectional view schematically illustrating a structure of an image forming apparatus 1 according to an embodiment of the present invention.

Referring to FIG. 1, the image forming apparatus 1 according to the present embodiment is an MFP and mainly includes a paper conveyor 10, a toner image former 20 (an example of an image former), and a fixing device 40.

The paper conveyor 10 conveys a piece of paper M (an example of a recording medium) in a conveyance direction AR1 along a conveyance track TR. The paper conveyor 10 includes a paper feeding tray 11, a paper feeding roller 12, a plurality of conveyance rollers 13, a paper ejection roller 14, and a paper ejection tray 15. The paper feeding tray 11 stores pieces of paper M used to form images thereon. There may be a plurality of paper feeding trays 11. The paper feeding roller 12 is provided between the paper feeding tray 11 and the conveyance track TR. Each of the plurality of conveyance rollers 13 is provided along the conveyance track TR. The paper ejection roller 14 is provided at the most downstream portion the conveyance track TR. The paper ejection tray 15 is provided at an uppermost portion of an image forming apparatus main body 1*a*.

The toner image former 20 combines images of four colors of yellow (Y), magenta (M), cyan (C), and black (K) in a so-called tandem system, and forms a toner image on a piece of conveyed paper M. The toner image former 20 includes an image forming unit 21 for each of the colors of Y, M, C, and K, an intermediate transfer belt 22, a primary transfer roller 23 for each of the colors of Y, M, C, and K, a secondary transfer roller 24, a cleaning device 30, a toner bottle 31 for each of the colors of Y, M, C, and K.

The image forming unit 21 for each of the colors of Y, M, C, and K includes a photoreceptor drum 25, a charging roller 26, an exposure device 27, a developing device 28, a cleaning device 29, and the like. The photoreceptor drum 25 is rotationally driven in a direction indicated by an arrow α in FIG. 1. The charging roller 26, developing device 28, and cleaning device 29 are provided around the photoreceptor drum 25. The charging roller 26 is provided in proximity to the photoreceptor drum 25. The exposure device 27 is provided under the photoreceptor drum 25.

The intermediate transfer belt 22 is provided above the image forming units 21 of the respective colors of Y, M, C, and K. The intermediate transfer belt 22 is annular and is stretched across rotational rollers 22*a*. The intermediate transfer belt 22 is rotationally driven in a direction indicated by an arrow β in FIG. 1. Each of the primary transfer rollers 23 for each of the colors of Y, M, C. and K faces each of the photoreceptor drums 25 interposing the intermediate transfer belt 22. The secondary transfer roller 24 contacts the intermediate transfer belt 22 in the conveyance track TR. The cleaning device 30 contacts a surface of the intermediate transfer belt 22. The toner bottle 31 for each of the colors of Y, M, C. and K contains toner and is provided above the intermediate transfer belt 22.

The fixing device 40 fixes a toner image on a piece of paper M by conveying the piece of paper formed with the toner image in the conveyance direction AR1 while nipping the piece of paper at a fixing nip.

In the image forming apparatus 1, the photoreceptor drum 25 is rotated to electrically charge a surface of the photoreceptor drum 25 with the charging roller 26. In the image forming apparatus 1, the charged surface of the photoreceptor drum 25 is exposed by the exposure device 27 in accordance with image forming information and an electrostatic latent image is formed on the surface of the photoreceptor drum 25.

Next, in the image forming apparatus 1, the toner is supplied from the developing device 28 to the photoreceptor drum 25 formed with the electrostatic latent image to perform development, and a toner image is formed on the surface of the photoreceptor drum 25.

Next, in the image forming apparatus 1, the toner image formed on the photoreceptor drum 25 is transferred to the surface of the intermediate transfer belt 22 by using the primary transfer roller 23 (primary transfer). In a case of a full-color image, a toner image combining toner images of respective colors of Y, M, C, and K is formed on the surface of the intermediate transfer belt 22.

In the image forming apparatus 1, toner that has not been transferred to the intermediate transfer belt 22 and remains on the photoreceptor drum 25 is removed by the cleaning device 29.

Subsequently, in the image forming apparatus 1, the toner image formed on the surface of the intermediate transfer belt 22 is conveyed by the rotational rollers 22*a* to a position facing the secondary transfer roller 24.

On the other hand, in the image forming apparatus 1, a piece of paper M stored in the paper feeding tray 11 is fed by the paper feeding roller 12, and guided to between the intermediate transfer belt 22 and the secondary transfer roller 24 by each of the plurality of conveyance rollers 13 along the conveyance track TR. Then, in the image forming apparatus 1, the toner image formed on the surface of the intermediate transfer bell 22 is transferred to the piece of paper M by the secondary transfer roller 24.

In the image forming apparatus 1, the toner that has not been transferred to the piece of paper M and remains on the surface of the intermediate transfer belt 22 is removed by the cleaning device 30. Additionally, in the image forming apparatus 1, the toner is supplied from the toner bottle 31 to the developing device 28 as necessary.

In the image forming apparatus 1, the piece of paper M to which the toner image has been transferred is guided to the fixing device 40, and the toner image is fixed on the piece of paper M by the fixing device 40. After that, in the image forming apparatus 1, the piece of paper M on which the toner image is fixed is ejected to the paper ejection tray 15 by the paper ejection roller 14.

Figure 2:
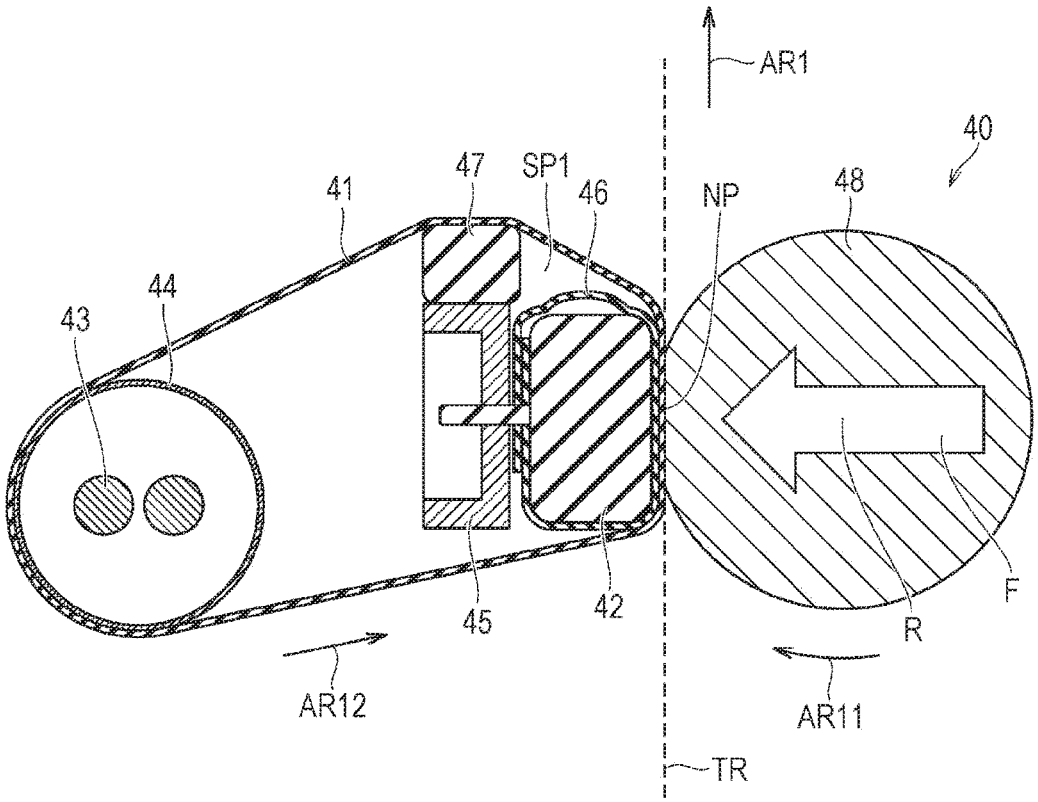
FIG. 2 is a cross-sectional view schematically illustrating a structure of a fixing device according to an embodiment of the present invention.
Figure 3:
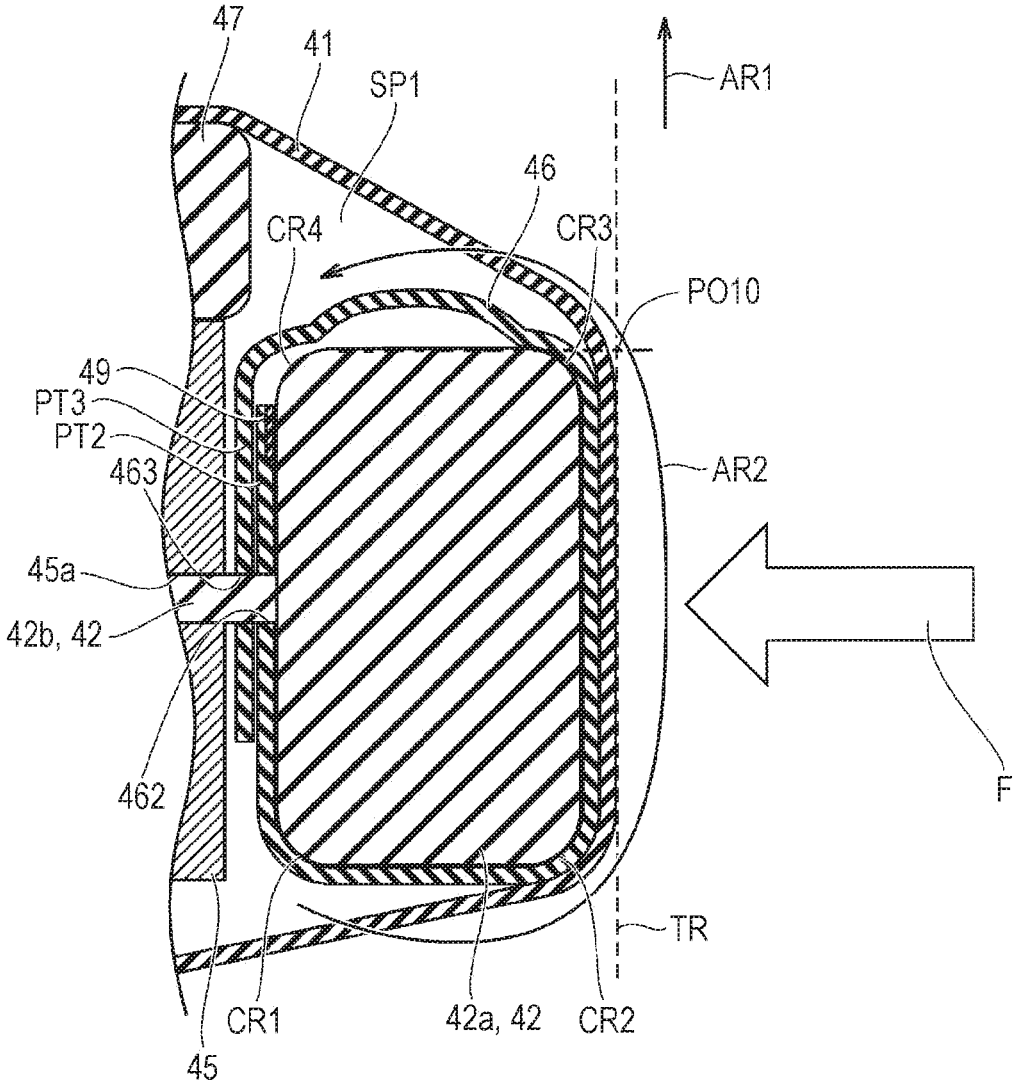
FIG. 3 is an enlarged view of the vicinity of a sliding sheet in FIG. 2.

FIG. 2 is a cross-sectional view schematically illustrating a structure of the fixing device 40 according to an embodiment of the present invention. FIG. 3 is an enlarged view of the vicinity of a sliding sheet 46 in FIG. 2.

Referring to FIGS. 2 and 3, the fixing device 40 includes a fixing belt 41 (an example of a belt), a pad 42 (an example of a pressing member), a halogen heater 43, a heating roller 44, a support member 45, a sliding sheet 46, a curvature adding member 47 (an example of a stretching member), and a pressurizing member 48.

The fixing belt 41 is an endless belt. The fixing belt 41 contacts the pressurizing member 48 in a pressurized manner and is supported at a position where a fixing nip NP is formed by having both ends in the axial direction of the fixing belt nipped by guide members (side plates not illustrated). The fixing belt 41 is stretched between the pad 42 and the heating roller 44. The fixing belt 41 is applied with tension by a biasing unit (not illustrated). The fixing belt 41 includes a base layer, an elastic layer formed on a surface of the base layer, and a releasing layer formed on the surface of the elastic layer. The base layer is made of polyimide (PI) or nickel (Ni) and has a thickness of about 50 μm to 100 μm. The elastic layer is made of silicone rubber or the like and has a thickness of about 100 μm to 300 μm. The releasing layer is made of a fluorine material or the like and has a thickness of about 10 μm to 50 μm.

The pad 42 is made of a liquid crystal polymer resin or the like and arranged on an inner side of the fixing belt 41. The pad 42 extends in parallel to an extending direction of a center axis R of the pressurizing member 48. The pad 42 presses the fixing belt 41 from the inner side of the fixing belt 41. The pad 42 includes a pad body 42*a* and a plurality of connecting shafts 42*b*. The pad body 42*a* is a portion of the pad 42 excluding the plurality of connecting shafts 42*b* and also is a portion that presses the fixing belt 41. The plurality of connecting shafts 42*b* protrudes in a direction to the support member 45 from a surface of the pad body 42*a* facing the support member 45 and is connected to the support member 45. Each of the plurality of connecting shafts 42*b* is provided along an extending direction of the pad 42. The plurality of connecting shafts 42*b* are integrally molded with the pad body 42*a*.

The halogen heater 43 is a heating source and is provided inside the heating roller 44. The halogen heater 43 extends parallel to the extending direction of the center axis R of the pressurizing member 48. The halogen heater 43 heats the fixing belt 41 to a predetermined target temperature via the heating roller 44. The halogen heater 43 includes two heaters having different heating regions in an extending direction of the halogen heater 43.

The heating roller 44 has a cylindrical shape and is provided on the inner side of the fixing belt 41. The heating roller 44 transfers heat of the halogen heater 43 to the fixing belt 41 and also is driven by rotation of the fixing belt 41. The heating roller 44 has a rotation axis parallel to the extending direction of the center axis R of the pressurizing member 48. The heating roller 44 is made of aluminum (Al) or stainless steel (SUS) and has a thickness of about 0.2 mm to 0.5 mm. An inner peripheral surface of the heating roller 44 is applied with back coating so as to increase an absorption rate of light generated from the halogen heater 43. A coating layer made of a fluorine material is provided on an outer peripheral surface of the heating roller 44 in order to prevent contamination.

The support member 45 is provided on the inner side the fixing belt 41. The support member 45 extends parallel to the extending direction of the center axis R of the pressurizing member 48. The support member 45 includes a plurality of through holes 45*a* formed on the side facing the pad 42. Each of the plurality of through holes 45*a* is formed along an extending direction of the support member 45 and is formed at a position facing each of the plurality of connecting shafts 42*b* of the pad 42. Each of the plurality of connecting shafts 42*b* passes through each of the plurality of through holes 45*a*. With this structure, the support member 45 supports the pad 42. The support member 45 is made of a U-shaped sheet metal and has a thickness of about 2 mm.

The sliding sheet 46 is wound around an outer peripheral surface of the pad 42 in a loosely fitted state along the conveyance direction AR1. The sliding sheet 46 is wound around the outer peripheral surface of the pad 42 once or more. When the fixing belt 41 is rotated with the sliding sheet 46 interposed between the fixing belt 41 and the pad 42, resistance between the fixing belt 41 and the pad 42 can be reduced, and the fixing belt 41 can be stably rotated. Note that it is preferable that a surface of the sliding sheet 46 on a side contacting the fixing belt 41 be provided with irregularities of about 50 μm to 200 μm. With this structure, the contact area with the fixing belt 41 is reduced, and frictional resistance between the fixing belt 41 and the sliding sheet 46 can be reduced during sliding (during rotation) of the fixing belt 41.

In the following description, a direction in which the conveyance direction AR1 extends along the sliding sheet 46 is defined as a winding direction AR2. The "loosely fitted state" is a state in which there is clearance between the pressing member and the sheet.

The curvature adding member 47 is made of a liquid crystal polymer resin or the like and fixed to the support member 45. The curvature adding member 47 stretches the fixing belt 41 on the inner side the fixing belt 41. At least a part of the curvature adding member 47 exists more on a downstream side (upper side in FIG. 3) in the conveyance direction AR than a position PO10 at a downstream end of the pad 42 in the conveyance direction AR1. The curvature adding member 47 is provided to form a space SP1. The space SP1 is a space between the fixing belt 41 and the pad 42 and also is a space located at a position more on a downstream side in the conveyance direction AR1 than the pad 42. Since the space SP1 is formed, a deflected portion of the sliding sheet 46 is retained in the space SP1 by pressing force F of the pressurizing member 48. Consequently, it is possible to avoid a situation in which a shape of the fixing belt 41 in the vicinity of the downstream end of the fixing nip NP becomes unstable by the deflected portion of the sliding sheet 46 unnecessarily pressing the fixing belt 41.

The pressurizing member 48 is a pressure roller here and is arranged at a position facing the pad 42 via the fixing belt 41 on the outer side of the fixing belt 41. The pressurizing member 48 forms the fixing nip NP with the fixing belt 41 by pressing, from the outer side of the fixing belt 41, a portion of the fixing belt 41 pressed against the pad 42 with the pressing force F. The pressurizing member 48 is a rotational body and rotationally driven in a direction indicated by an arrow AR11. The fixing belt 41 is rotated in a direction indicated by an arrow AR12 by being driven by rotation of the pressurizing member 48. The pressurizing member 48 includes an elastic layer and a releasing layer formed on a surface of the elastic layer. The elastic layer is made of silicone rubber and has a diameter of about 20 mm to 40 mm. The releasing layer is formed of a tube or the like made of a fluorine material in order to improve a releasing property.

Figure 4:
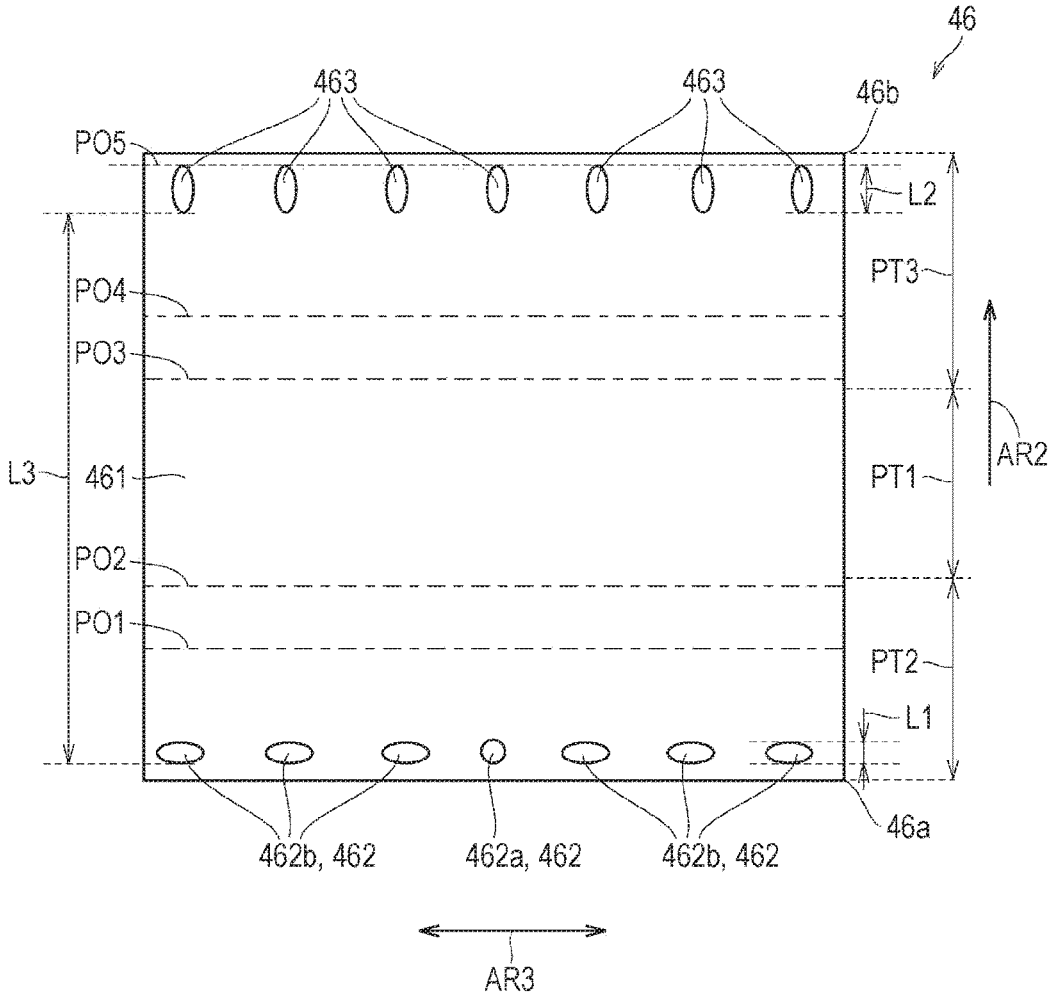
FIG. 4 is a plan view illustrating a structure of the sliding sheet in a state not wound around a pad in an embodiment of the present invention.

FIG. 4 is a plan view illustrating a structure of the sliding sheet 46 in a state not wound around the pad 42 in an embodiment of the present invention. In FIG. 4, a surface side of the sliding sheet 46 in contact with the pad 42 is illustrated.

Referring to FIGS. 3 and 4, the sliding sheet 46 is divided into a contact region PT1, an upstream region PT2, and a downstream region PT3. The contact region PT1 is a region contacting the fixing belt 41 and the pad 42. The upstream region PT2 is a region located more on the upstream side (lower side in FIG. 4) in the winding direction AR2 than the contact region PT1 of the sliding sheet 46. The downstream region PT3 is a region located more on the downstream side in the winding direction AR2 (upper side in FIG. 4) than the contact region PT1 of the sliding sheet 46. The upstream region PT2 includes an upstream end 46*a* in the winding direction AR2 of the sliding sheet 46. The downstream region PT3 includes a downstream end 46*b* in the winding direction AR2 of the sliding sheet 46. A part of the upstream region PT2 and a part of the downstream region PT3 of a sliding sheet body 461 are interposed between the pad 42 and the support member 45 and fixed by the pressing force F by which the pressurizing member 48 presses the fixing belt 41.

The sliding sheet 46 includes the sliding sheet body 461, a plurality of upstream holes 462, and a plurality of downstream holes 463. The sliding sheet body 461 has a rectangular planar shape. The sliding sheet body 461 is made of a glass cloth sheet or a polytetrafluoroethylene (PTFE) sheet covered with a fluororesin having an excellent sliding property.

The plurality of upstream holes 462 is formed in the upstream region PT2 of the sliding sheet body 461. When the sliding sheet is wound around the pad 42, each of the plurality of upstream holes 462 is formed at a position corresponding to each of the plurality of connecting shafts 42*b* and arrayed along a longitudinal direction AR3 of the sliding sheet 46. The longitudinal direction AR3 of the sliding sheet 46 is a direction parallel to the extending direction of the pad 42 when the sliding sheet is wound around the pad 42 and also is a direction orthogonal to the winding direction AR2. The plurality of upstream holes 462 includes: a circular hole 462*a* (an example of a first region) having substantially the same size as the connecting shaft 42*b*; and a plurality of elongated holes 462*b* (an example of a second region) extending in the longitudinal direction AR3 of the sliding sheet 46. A length along the longitudinal direction AR3 of the circular hole 462*a* is shorter than a length along the longitudinal direction AR3 of each of the elongated holes 462*b*. The circular hole 462*a* is formed at a center in the longitudinal direction AR3 of the sliding sheet 46. The plurality of elongated holes 462*b* interposes the circular hole 462*a* and is formed at both ends in the longitudinal direction AR3 of the sliding sheet 46. Note that the number of the circular holes 462*a* and the number of the elongated holes 462*b* are arbitrary.

The plurality of downstream holes 463 is formed in the downstream region PT3 of the sliding sheet body 461. When the sliding sheet is wound around the pad 42, each of the plurality of downstream holes 463 is formed at a position corresponding to each of the plurality of connecting shafts 42*b* and arrayed along the longitudinal direction AR3 of the sliding sheet 46. Each of the plurality of downstream holes 463 has the same shape and extends in the winding direction AR2. A length L2 in the winding direction AR2 of each of the plurality of downstream holes 463 is longer than a length L1 in the winding direction AR2 of each of the plurality of upstream holes 462. A downstream end in each of the plurality of downstream holes 463 in the winding direction AR2 is provided at the same position PO5 along the winding direction AR2.

Each of the plurality of connecting shafts 42*b* passes through each of the plurality of upstream holes 462 and each of the plurality of downstream holes 463.

Note that the upstream hole 462 and the downstream hole 463 in the sliding sheet 46 have arbitrary shapes.

Figure 5:
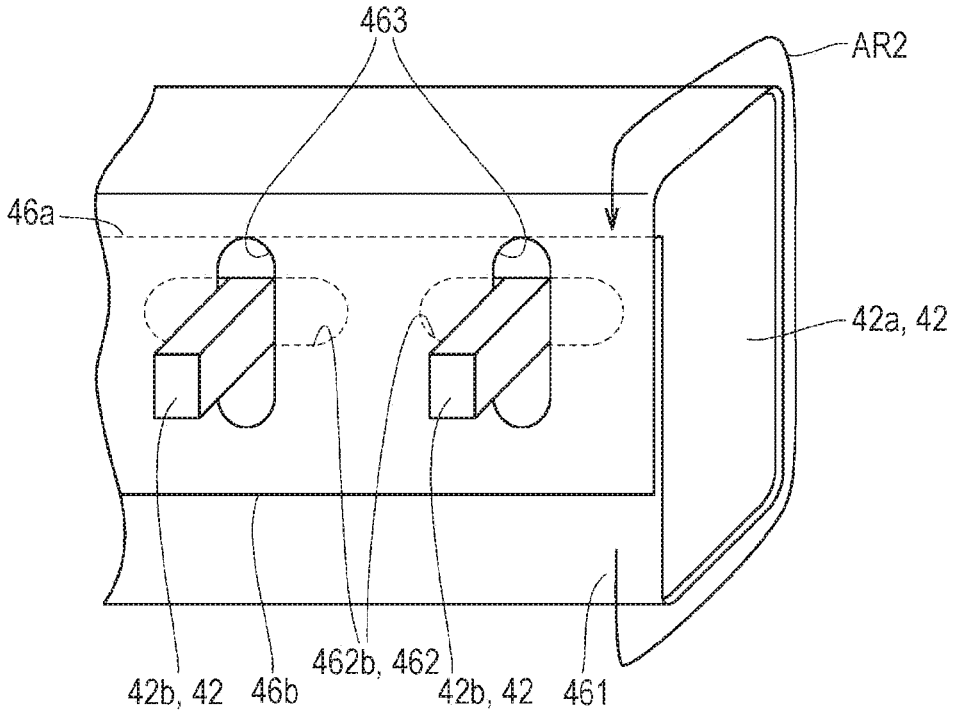
FIG. 5 is a perspective view illustrating a structure of a part of the pad and a part of the sliding sheet in the view from a side where a support member exists.

FIG. 5 is a perspective view illustrating a structure of a part of the pad 42 and a part of the sliding sheet 46 in the view from a side where the support member 45 exists.

Referring to 3 to 5, the sliding sheet 46 and the pad 42 are incorporated in the fixing device 40 in the following manner. Initially, each of the plurality of connecting shafts 42*b* of the pad 42 is made to pass through each of the plurality of upstream holes 462 of the sliding sheet 46. Consequently, the sliding sheet 46 is hung at the pad 42.

At this point, a position of the sliding sheet 46 in the longitudinal direction AR3 can be determined by the circular hole 462*a* out of the plurality of upstream holes 462. Additionally, a positional deviation in the longitudinal direction AR3 caused by dimensional tolerance between the upstream holes 462 and the connecting shafts 42*b* can be absorbed by the elongated holes 462*b*, and assemblability of the sliding sheet 46 can be improved.

Additionally, the upstream region PT2 of the sliding sheet 46 is a region that receives tensile force by rotation of the pressurizing member 48. Since the length L1 in the winding direction AR2 of each of the upstream holes 462 is shorter than the length L2 in the winding direction AR2 of each of the downstream holes 463 (formed in a size approximately same as the connecting shaft 42*b*), movement or displacement of the upstream region PT2 of the sliding sheet 46 caused by the tensile force by rotation of the pressurizing member 48 can be suppressed, and the sliding sheet 46 is hardly wrinkled.

Meanwhile, when each of the plurality of connecting shafts 42*b* is made to pass through each of the plurality of upstream holes 462, a double-stick tape 49 (FIG. 3) may be pasted along an entire longitudinal direction AR3 in the vicinity of the upstream end 46*a* of the sliding sheet 46, and the pad 42 and the sliding sheet 46 may be bonded by the pasted double-stick tape 49. With this structure, the sliding sheet 46 can be stably fixed to the pad 42. On the other hand, in a case where fixing force of the sliding sheet 46 can be sufficiently secured by the pressing force F of the pressurizing member 48, the double-stick tape 49 is not necessary.

Next, the sliding sheet 46 is wound around the outer peripheral surface of the pad 42 from the upstream side to the downstream side of the fixing nip NP along the winding direction AR2, and each of the plurality of connecting shafts 42*b* of the pad 42 is made to pass through the plurality of downstream holes 463 of the sliding sheet 46. With this structure, the sliding sheet 46 is wound around the pad 42 in a loosely fitted state.

At this point, a distance L3 between the upstream holes 462 and the downstream holes 463 (distance L3 from the upstream ends of the upstream holes 462 in the winding direction AR2 to the upstream ends of the downstream holes 463 in the winding direction AR2) is set longer than a length of the outer peripheral surface of the pad 42 such that the sliding sheet 46 is wound around the outer peripheral surface of the pad 42 in a loosely fitted state. As an example, in a case where the length of the outer peripheral surface of the pad 42 is 40 mm, the distance L3 is 45 mm. Additionally, since each of the downstream holes 463 has an elongated hole shape extending in the winding direction AR2, a positional deviation in the winding direction AR2 caused by dimensional tolerance between the downstream holes 463 and the connecting shafts 42*b* can be absorbed, and assemblability of the sliding sheet 46 can be improved.

Next, the plurality of connecting shafts 42*b* of the pad 42 is made to pass through the plurality of through holes 45*a* of the support member 45. With this structure, the pad 42 and the sliding sheet 46 are supported by the support member 45. A part of the upstream region PT2 and a part of the downstream region PT3 of the sliding sheet 46 are interposed between the pad 42 and the support member 45 in a superimposed state. The part of the upstream region PT2 interposed between the pad 42 and the support member 45 becomes a side closer to the pad 42 than the part of the downstream region PT3 interposed between the pad 42 and the support member 45. In this state, the portion of the sliding sheet 46 interposed between the pad 42 and the support member 45 is movable with respect to the connecting shafts 42*b*.

After that, the fixing belt 41 is stretched around the pad 42, heating roller 44, and curvature adding member 47, and the pad 42 is pressed by the pressurizing member 48. Consequently, the position of the sliding sheet 46 wound around the pad 42 is fixed in a state being interposed between the pad 42 and the support member 45 by the pressing force F of the pressurizing member 48.

Note that the pad 42 includes a plurality of corners CR1, CR2, CR3, and CR4. Positions on the sliding sheet 46 contacting the corners CR1, CR2, CR3, and CR4 respectively when the sliding sheet 46 is wound around the pad 42 are defined as positions PO1, PO2, PO3, and PO4, respectively. Preferably, the sliding sheet body 461 includes folding line formed at the positions PO1, PO2, and PO4 corresponding to the part of the plurality of corners CR1, CR2, CR3, and CR4. In this case, preferably, at least no folding line is formed at the position PO3 of the sliding sheet body 461 corresponding to the corner CR3 existing at a position closest to the downstream end in the conveyance direction AR1 of the fixing nip NP. With this structure, the sliding sheet 46 can be positioned on the pad 42 by the folding lines formed at the positions PO1, PO2, and PO4, and at the same time, since no folding line is formed at the position PO3, the deflected portion of the sliding sheet 46 can be positioned in the space SP1.

According to the present embodiment, since the sliding sheet 46 is fixed by the pressing force F with which the pressurizing member 48 presses the fixing belt 41, it is necessary to use a sheet metal or a fixture to fix the sliding sheet 46. As a result, excellent assemblability of the fixing device can be achieved, and an increase in the number of parts of the fixing device can be suppressed.

Additionally, since the sliding sheet 46 is wound around the pad 42 in a loosely fitted state, the sliding sheet 46 is pressed by the pressurizing member 48 while receiving force in a direction to stretch the looseness by rotation of the pressurizing member 48. Consequently, it is possible to prevent the sliding sheet 46 of the fixing nip NP from being wrinkled, and occurrence of an image defect can be suppressed.

Furthermore, since a part of the upstream region PT2 and a part of the downstream region PT3 of the sliding sheet 46 are interposed between the pad 42 and the support member 45, the sliding sheet 46 can be prevented from being wrinkled in a case where the sliding sheet 46 is subjected to the force in an opposite direction of the winding direction AR2 when the fixing belt 41 and the pressurizing member 48 are respectively rotated in reverse directions due to jam handling.

Modified Examples

Figure 6A:
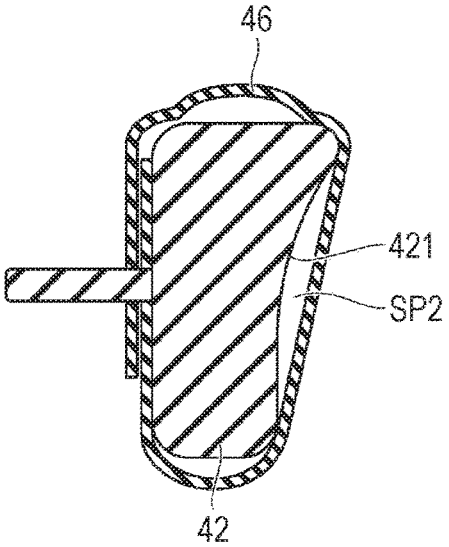
FIGS. 6A and 6B are cross-sectional views illustrating a structure in the vicinity of the pad in the fixing device according to a first modified example of the embodiment of the present invention.
Figure 6B:
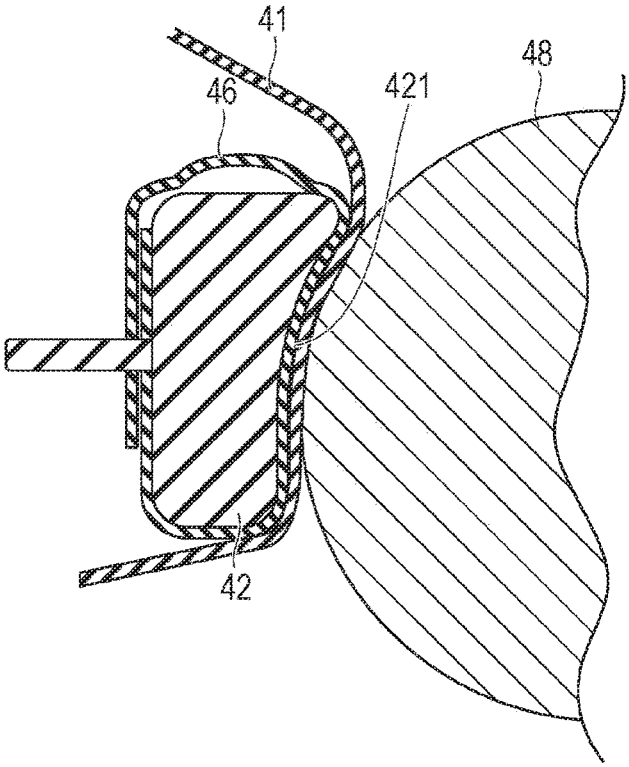

FIGS. 6A and 6B are cross-sectional views illustrating a structure in the vicinity of the pad 42 in the fixing device 40 according to a first modified example of the embodiment of the present invention. FIG. 6A is a view illustrating the structures of the pad 42 and the sliding sheet 46 in a state where no pressing force F is applied from the pressurizing member 48. FIG. 6B is a view illustrating the structures of the pad 42 and the sliding sheet 46 in a state where the pressing force F is applied from the pressurizing member 48.

Referring to FIG. 6A, in the fixing device 40 of the first modified example, the surface of the pad 42 located on the pressurizing member 48 side includes a recess 421. Since the recess 421 is provided, a space SP2 is formed between the recess 421 and the sliding sheet 46 in the case where the sliding sheet 46 is wound around the pad 42 in a loosely fitted state.

Referring to FIG. 6B, according to the first modified example, the space SP2 is pressed by the pressurizing member 48 and the sliding sheet 46 is expanded in a manner extending along the surface of the recess 421. As a result, the sliding sheet 46 is hardly wrinkled.

Figure 7A:
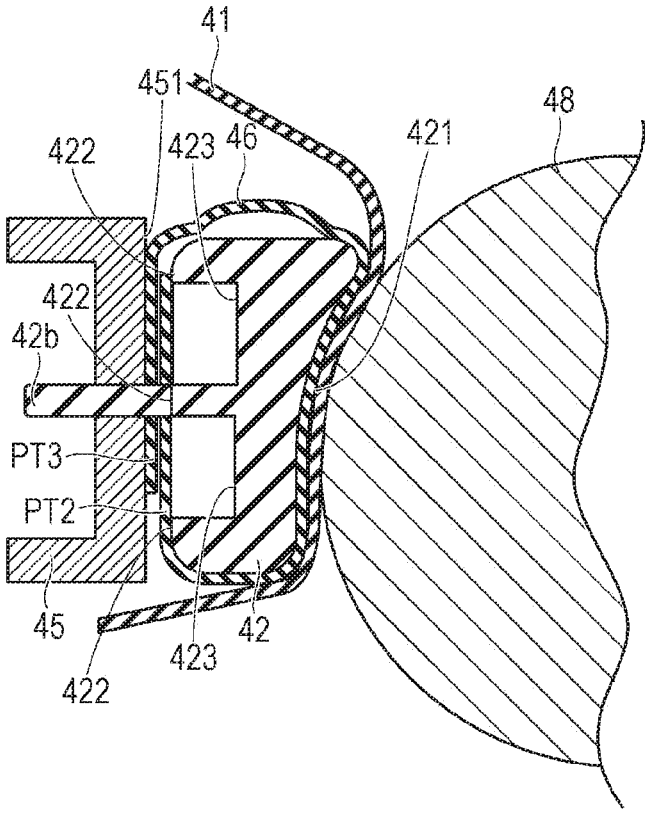
FIGS. 7A and 7B are diagrams illustrating a structure in the vicinity of the pad in the fixing device according to a second modified example of the embodiment of the present invention.
Figure 7B:
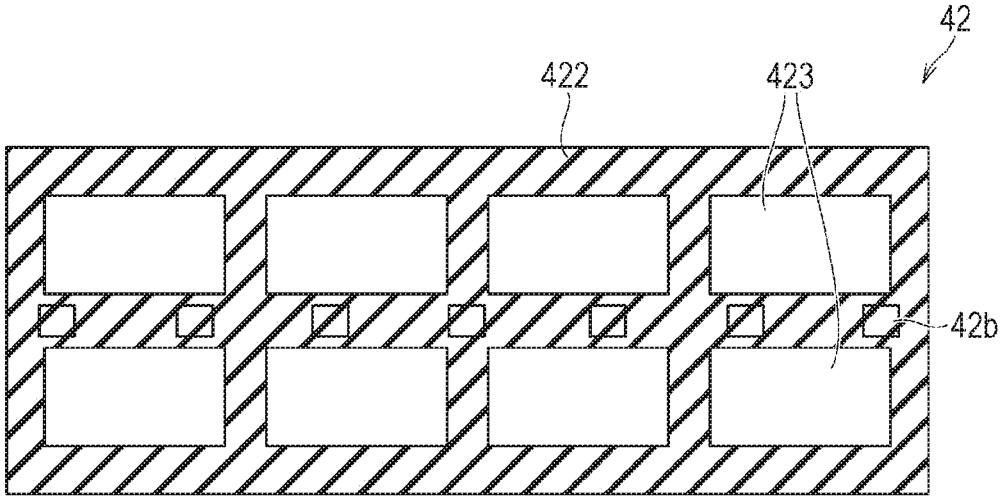

FIGS. 7A and 7B are diagrams illustrating a structure in the vicinity of the pad 42 in the fixing device 40 according to a second modified example of the embodiment of the present invention. FIG. 7A is a cross-sectional view. FIG. 7B is a view illustrating a structure of the pad 42 in the view from the support member 45 side.

Referring to FIGS. 7A and 7B, in the fixing device 40 of the second modified example, the surface of the pad 42 located on the support member 45 side includes a flat surface 422 and recesses (thin portion) 423. The flat surface 422 has a lattice-like shape. The recesses 423 are formed adjacent to the lattice-like flat surface 422. The support member 45 includes a flat surface 451 at a position facing the flat surface 422. A part of the upstream region PT2 of the sliding sheet 46 is interposed between the flat surface 422 and the flat surface 451. Additionally, it is preferable that a part of the downstream region PT3 of the sliding sheet 46 be also interposed between the flat surface 422 and the flat surface 451.

According to the second modified example, the volume of the pad 42 can be reduced by providing the recess 423. As a result, thermal capacity of the pad 42 can be reduced, and a material necessary to manufacture the pad 42 can be reduced. Furthermore, since the sliding sheet 46 is interposed between the flat surface 422 of the pad 42 and the flat surface 451 of the support member 45, the sliding sheet 46 can be more stably fixed.

Figure 8:
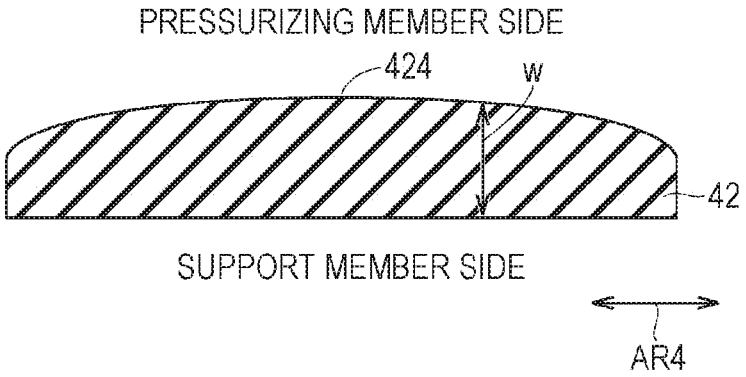
FIG. 8 is a cross-sectional view illustrating a structure of the pad in the fixing device according to a third modified example of the embodiment of the present invention.

FIG. 8 is a cross-sectional view illustrating a structure of the pad 42 in the fixing device 40 according to a third modified example of the embodiment of the present invention.

Referring to FIG. 8, the pad 42 and the support member 45 may be deflected in a direction away from the pressurizing member 48 by the pressing force F of the pressuring member 48 as a result of long-term use of the fixing device 40. When the pad 42 and the support member 45 are deflected, a width at a center position of the fixing nip NP (length in the conveyance direction AR1 of the fixing nip NP) in a direction orthogonal to the conveyance direction AR1 (longitudinal direction AR4 in which the pad 42 extends) may be shortened.

To avoid such a situation, a thickness w of the pad 42 is gradually reduced from a center position 424 to each of both ends in the longitudinal direction AR4 of the pad 42 in the fixing device 40 of the third modified example. Since the pad 42 is thus shaped, deflection of the pad 42 can be suppressed, and a fixing nip width at the center position 424 can be secured. As a result, excellent fixing performance can be achieved without increasing the number of components.

Figure 9:
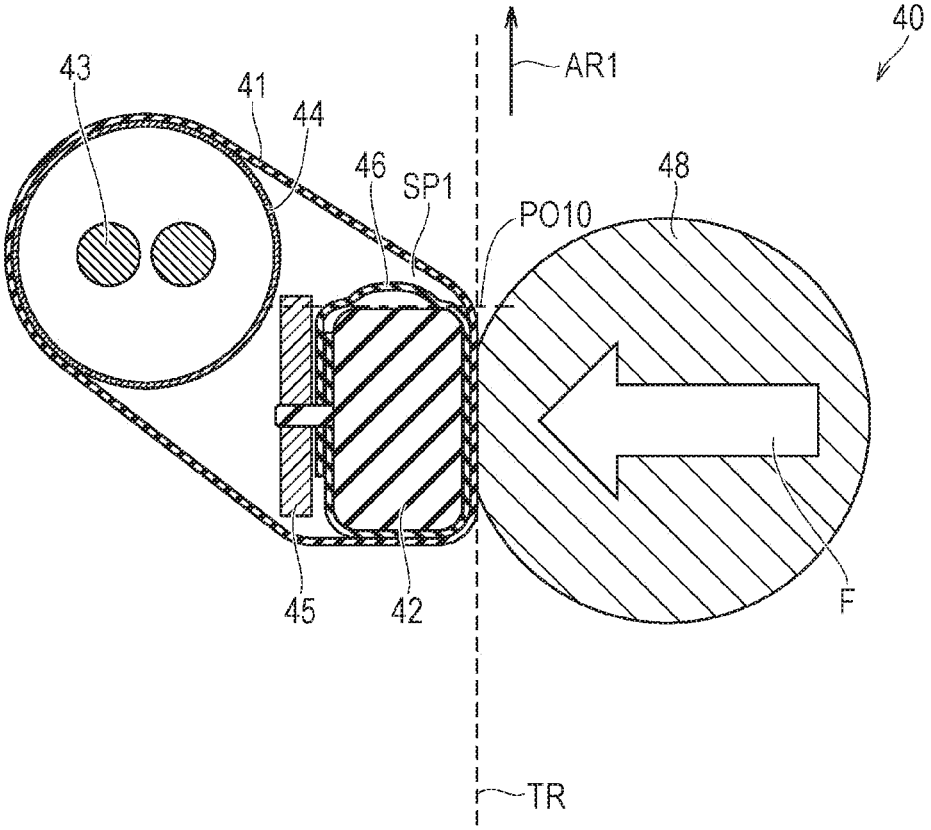
FIG. 9 is a cross-sectional view illustrating a structure of the fixing device according to a fourth modified example of the embodiment of the present invention.

FIG. 9 is a cross-sectional view illustrating a structure of the fixing device 40 according to a fourth modified example of the embodiment of the present invention.

Referring to FIG. 9, the fixing device 40 of the fourth modified example does not include the curvature adding member 47 (FIG. 2). At least a part of the heating roller 44 (an example of a stretching member) exists more on the downstream side (upper side in FIG. 9) than a position PO10 at the downstream end in the conveyance direction AR1 of the pad 42. With this structure, a space SP1 is formed by the heating roller 44. Since the space SP1 is formed, a deflected portion of the sliding sheet 46 is retained in the space SP1 by pressing force F of the pressurizing member 48.

According to the fourth modified example, the deflected portion of the sliding sheet 46 caused by the pressing force F of the pressurizing member 48 can be retained in the space SP1 without providing the curvature adding member 47.

Note that components in the fixing device 40 other than the above-described components in the first to fourth modified examples are similar to those of the fixing device in the above-described embodiment, and therefore, a description thereof will not be repeated.

Others

The fixing device as an object of the present invention may be of a direct heating type in which the belt is not stretched around a heating roller and the belt is directly heated by a heater or may be the one in which an induction heating (111) system or a heat generation sheet is used as a heating source. Additionally, the fixing device to be an object of the present invention may include a belt, a pressing member, a support member, and a sheet as components on the side of the pressurizing member that pressurizes the fixing roller.

The above embodiment and modified examples can be suitably combined.

Although embodiments and modifications of the present invention have been described and illustrated in detail, the disclosed embodiments are made for purposes of illustration and example only and not limitation. The scope of the present invention should be interpreted by terms of the appended claims. The scope of the present invention is intended to include any modifications within the meaning and range equivalent to the claims.

What is claimed is:

1. A fixing device that fixes a toner image onto a piece of paper by conveying, in a predetermined conveyance direction, the piece of paper formed with the toner image while nipping the piece of paper at a fixing nip, the fixing device comprising:

an endless belt that is rotated;

a pressing member that is arranged on an inner side of the belt and presses the belt from the inner side;

a support member that supports the pressing member;

a sheet wound around the pressing member along the conveyance direction in a loosely fitted state; and a pressurizing member that is arranged on an outer side of the belt and forms the fixing nip with the belt by pressing, from the outer side of the belt, a part of the belt pressed by the pressing member, wherein in a case of defining, as a winding direction, a direction obtained by extending the conveyance direction along the sheet, a part of an upstream region of the sheet existing more on an upstream side in the winding direction than a contact region contacting the belt and the pressing member and a part of a downstream region of the sheet existing more on a downstream side in the winding direction than the contact region are interposed between the pressing member and the support member, and are fixed by pressing force with which the pressurizing member presses the belt.

2. The fixing device according to claim 1, wherein the sheet is wound around an outer peripheral surface of the pressing member once or more.

3. The fixing device according to claim 1, wherein the pressing member includes a plurality of connecting shafts, the support member includes a plurality of through holes, and each of the plurality of connecting shafts passes through each of the plurality of through holes.

4. The fixing device according to claim 3, wherein the sheet includes:

a sheet body;

a plurality of upstream holes formed in the upstream region of the sheet body; and a plurality of downstream holes formed in the downstream region of the sheet body, wherein each of the plurality of connecting shafts passes through each of the plurality of upstream holes and each of the plurality of downstream holes, and a length of each of the plurality of downstream holes in the winding direction is longer than a length of each of the plurality of upstream holes in the winding direction.

5. The fixing device according to claim 4, wherein a length in a direction orthogonal to the conveyance direction of an upstream hole in a first region out of the plurality of upstream holes is shorter than a length in the direction orthogonal to the conveyance direction of an upstream hole in each of second regions interposing the first region out of the plurality of upstream holes.

6. The fixing device according to claim 4, wherein downstream ends in the winding direction of the plurality of downstream holes are respectively provided at the same positions along the winding direction.

7. The fixing device according to claim 3, wherein the plurality of connecting shafts is integrally molded with a part of the pressing member.

8. The fixing device according to claim 1, further comprising a stretching member that stretches the belt on the inner side of the belt and at least partly exists more on the downstream side in the conveyance direction than a position at a downstream end in the conveyance direction of the pressing member.

9. The fixing device according to claim 1, wherein a surface of the pressing member located on the pressurizing member side includes a recess.

10. The fixing device according to claim 1, wherein the pressing member includes a plurality of corners, the sheet includes folding lines formed at positions corresponding to a part of the plurality of corners, and no folding line is formed at a position of the sheet corresponding to at least a corner of the pressing member existing at a position closest to a downstream end in the conveyance direction of the fixing nip.

11. The fixing device according to claim 1, wherein a surface of the pressing member located on the support member side includes:

a flat surface; and a recess formed adjacent to the flat surface.

12. The fixing device according to claim 11, wherein a part of the upstream region of the sheet is interposed between the flat surface and the support member.

13. The fixing device according to claim 1, wherein the pressing member has a longitudinal direction in a direction orthogonal to the conveyance direction, and a thickness of the pressing member is gradually reduced from a center position to each of both ends in the longitudinal direction.

14. The fixing device according to claim 1, wherein a part of the upstream region interposed between the pressing member and the support member and a part of the downstream region interposed between the pressing member and the support member are superimposed such that the part of the upstream region interposed between the pressing member and the support member becomes a side closer to the pressing member than the part of the downstream region interposed between the pressing member and the support member.

15. An image forming apparatus comprising:

an image former that forms a toner image on the paper; and the fixing device according to claim 1.

* * * * *